US007419168B2

(12) United States Patent
Felty

(10) Patent No.: US 7,419,168 B2
(45) Date of Patent: Sep. 2, 2008

(54) SKATEBOARD WHEEL AND AXLE ASSEMBLY

(76) Inventor: Paul G. Felty, 4903 19th Ave. SE., Lacey, WA (US) 98503

( * ) Notice: Subject to any disclaimer, the term of this patent is extended or adjusted under 35 U.S.C. 154(b) by 0 days.

(21) Appl. No.: 11/902,937

(22) Filed: Sep. 26, 2007

(65) Prior Publication Data

US 2008/0079231 A1 Apr. 3, 2008

Related U.S. Application Data

(60) Provisional application No. 60/847,643, filed on Sep. 28, 2006.

(51) Int. Cl.
*B62M 1/00* (2006.01)

(52) U.S. Cl. ..... 280/11.223; 280/87.042; 280/87.041; 280/11.27; 280/11.225; 280/11.28

(58) Field of Classification Search ..... 280/11.223, 280/87.042, 87.041, 11.27, 11.225, 11.28
See application file for complete search history.

(56) References Cited

U.S. PATENT DOCUMENTS

| | | | | |
|---|---|---|---|---|
| 3,361,447 | A | 1/1968 | Engelmann | |
| 4,114,952 | A | 9/1978 | Kimmell | |
| 4,960,344 | A | 10/1990 | Geisthoff et al. | |
| 5,853,182 | A | 12/1998 | Finkle | |
| 5,961,132 | A * | 10/1999 | Post | 280/11.223 |
| 5,988,656 | A | 11/1999 | Krah | |
| D421,082 | S | 2/2000 | Lopez | |
| 6,331,091 | B2 | 12/2001 | Cross | |
| 6,367,819 | B1 * | 4/2002 | Andersen et al. | 280/11.28 |
| 6,428,023 | B2 | 8/2002 | Reyes et al. | |
| D477,648 | S | 7/2003 | Smith | |
| 6,607,198 | B2 * | 8/2003 | Szendel | 280/11.27 |
| 6,659,480 | B1 | 12/2003 | Newman | |
| 6,666,614 | B2 * | 12/2003 | Fechter et al. | 403/321 |
| 6,884,013 | B2 | 4/2005 | Kiviranta et al. | |
| 6,913,272 | B2 | 7/2005 | Chang | |
| 6,979,007 | B1 | 12/2005 | Hosoda | |
| 7,007,957 | B1 | 3/2006 | Lee | |
| 7,044,485 | B2 | 5/2006 | Kent et al. | |

(Continued)

FOREIGN PATENT DOCUMENTS

EP 0573677 A1 12/1993

(Continued)

*Primary Examiner*—Christopher Ellis
*Assistant Examiner*—Cynthia F Collado
(74) *Attorney, Agent, or Firm*—Richard C. Litman

(57) ABSTRACT

The skateboard wheel and axle assembly includes an axle rigidly mounted in a hangar, with opposite ends of the axle extending from the hangar. Each end of the axle has an axial blind bore defined therein closed by an end cap and a plurality of holes defined radially adjacent the end cap. A spring-biased detent pin slidably mounted in the bore urges a plurality of detent balls to partially extend from the radially disposed holes. The detent balls engage an annular groove defined in the inner race of the outer wheel bearing to retain the wheel on the axle. The detent pin has a release arm extending through aligned slots in the axle and the hangar that can be retracted, compressing the bias spring, in order to withdraw the detent balls from the groove so that the wheel can be pulled off the axle.

8 Claims, 3 Drawing Sheets

U.S. PATENT DOCUMENTS

| | | | | |
|---|---|---|---|---|
| 7,125,024 | B1 * | 10/2006 | Kelly | 280/11.27 |
| 2001/0009632 | A1 | 7/2001 | Cross | |
| 2002/0070512 | A1 | 6/2002 | Szendel | |
| 2004/0140633 | A1 | 7/2004 | Beedle et al. | |
| 2006/0087087 | A1 | 4/2006 | Stratton | |
| 2006/0131826 | A1 | 6/2006 | Schonelom et al. | |

FOREIGN PATENT DOCUMENTS

| | | | |
|---|---|---|---|
| EP | 0628735 | A1 | 12/1994 |
| WO | WO9423810 | | 10/1994 |

* cited by examiner

SKATEBOARD WHEEL AND AXLE ASSEMBLY

CROSS-REFERENCE TO RELATED APPLICATION

This application claims the benefit of U.S. Provisional Patent Application Ser. No. 60/847,643, filed Sep. 28, 2006.

BACKGROUND OF THE INVENTION

1. Field of the Invention

The present invention relates to skateboards, and particularly to a wheel and axle assembly that provides for a quick release coupling between the wheel and the axle.

2. Description of the Related Art

Wheels of skateboards, roller skates and the like are typically made from polyurethane or other plastics and, thus, are subject to fracture, erosion and other forms of damage during use. The wheels include bearings press fit into the wheel hubs that occasionally become misaligned. Typical skateboard wheels are held to their respective axles by nuts threaded onto the axles. Replacement of the wheels requires use of a wrench to remove the retaining nut, which requires some time and effort. In addition to the time and effort required to remove the nuts, close contact with the wheels, and particularly with the axles or bearings, may result in axle grease or the like staining the user's clothing or skin.

It would be desirable to provide a wheel and axle assembly that provides for quick release of the wheel from the axle without the use of tools. Thus, a skateboard wheel and axle assembly solving the aforementioned problems is desired.

SUMMARY OF THE INVENTION

The skateboard wheel and axle assembly includes an axle rigidly mounted in a hangar, with opposite ends of the axle extending from the hangar. Each end of the axle has an axial blind bore defined therein, the bore being closed by an end cap, end plug, or the like. The axle also has a plurality of holes defined radially therein adjacent the end cap. A detent pin is slidably mounted in the bore, the detent pin having a release arm extending through aligned slots defined in the axle and the hangar. A plurality of detent balls are disposed in the bore between the pin and the end cap, the balls having a slightly larger diameter than the holes. A compression spring is seated medially in the bore, biasing the detent pin toward the end cap and urging the detent balls against the holes so that a portion of each ball extends outside the axle.

Each wheel has inner and outer bearings press fit in its hub, the inner race of the outer bearing having an annular groove defined therein. The wheel is pressed over the end of the axle, the detent balls snapping into the groove in the outer bearing to retain the wheel on the axle. The wheel is removed by pushing the release arm towards the center of the axle, the slot permitting the detent pin to retract just enough to permit the detent balls to collapse into the bore so that the wheel can be pulled off the axle.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
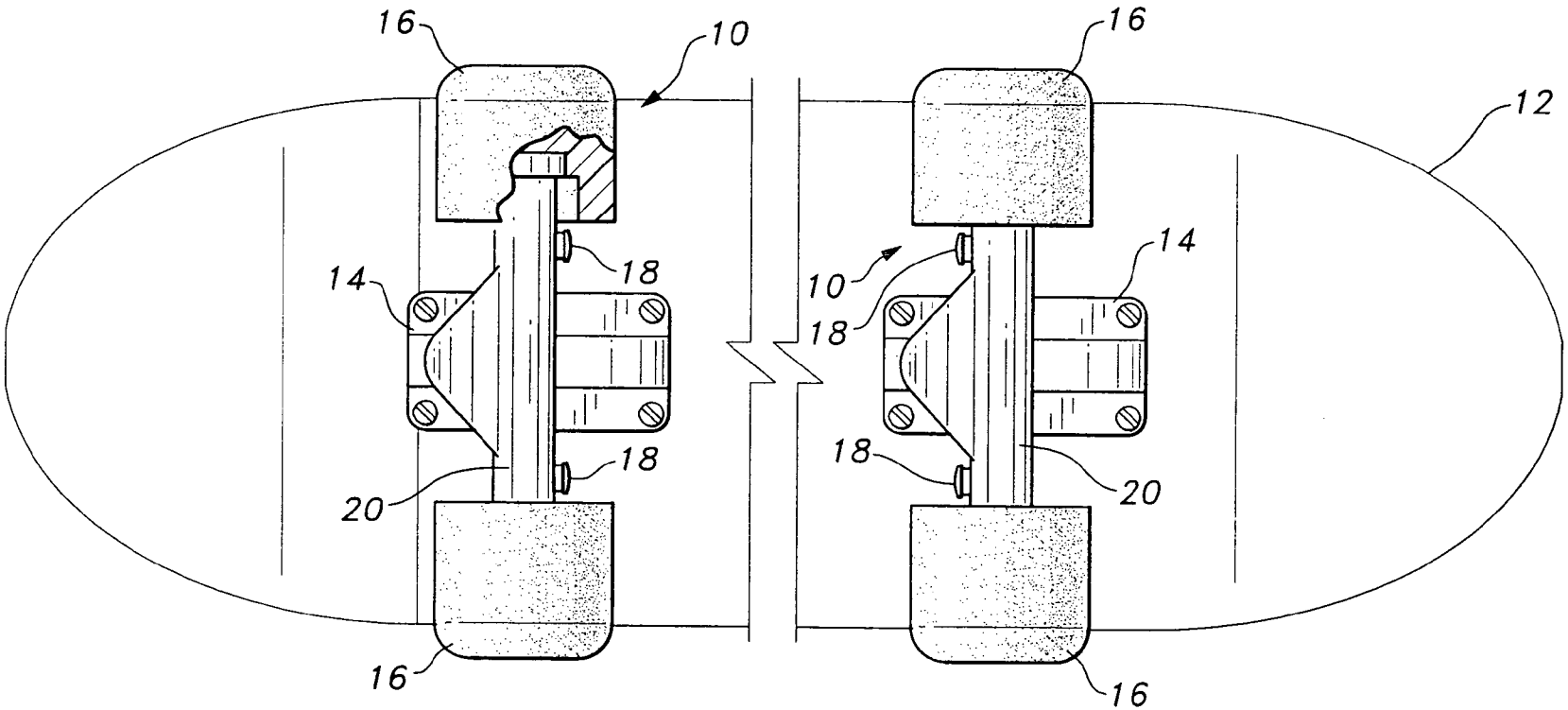
FIG. 1 is an environmental bottom view of an exemplary skateboard having a skateboard wheel and axle assembly according to the present invention, one of the wheels being broken away to show details of the invention.

The present invention is directed to a skateboard wheel and axle assembly, designated generally as 10 in the drawings. FIG. 1 illustrates four such locking wheel assemblies 10 mounted to an exemplary skateboard 12. The wheels 16 are attached to the skateboard 12 by trucks 14 including a hangar 20 or axle housing extending laterally across the skateboard. Each hangar 20 has a slot defined therein adjacent each end through which a release arm 18 extends, with the release arm 18 being slidable in the slot for attaching the wheels 16 to the axle and detaching the wheels 16 from the axle. The trucks 14 are otherwise conventional and stylistic and design choices, such as dimensions and contouring, are dependent upon the particular needs and desires of the user.

Figure 2:
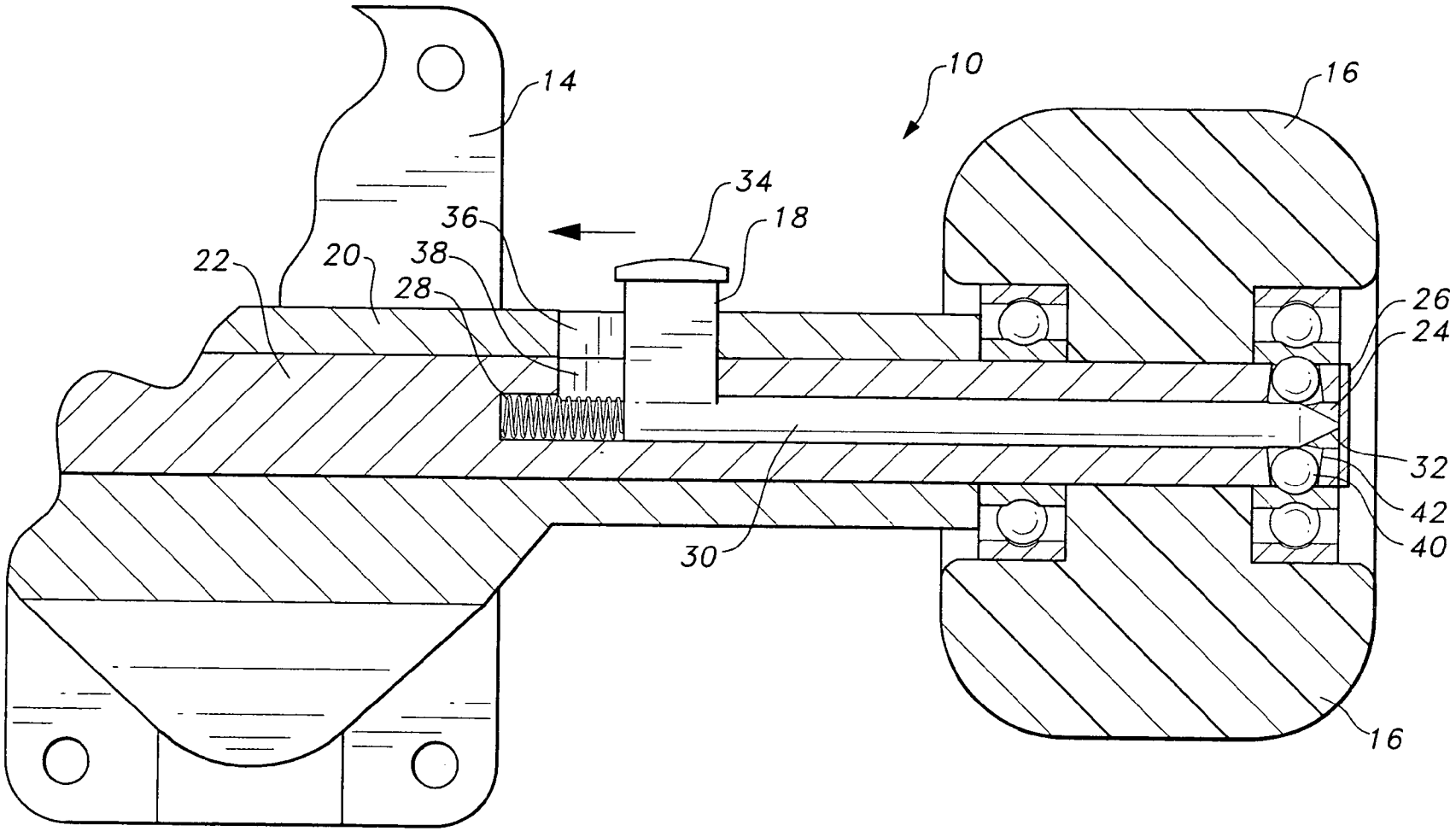
FIG. 2 is a partial section view of the skateboard wheel and axle assembly according to the present invention showing the wheel attached to the axle, the detent pin being in the extended position.
Figure 3:
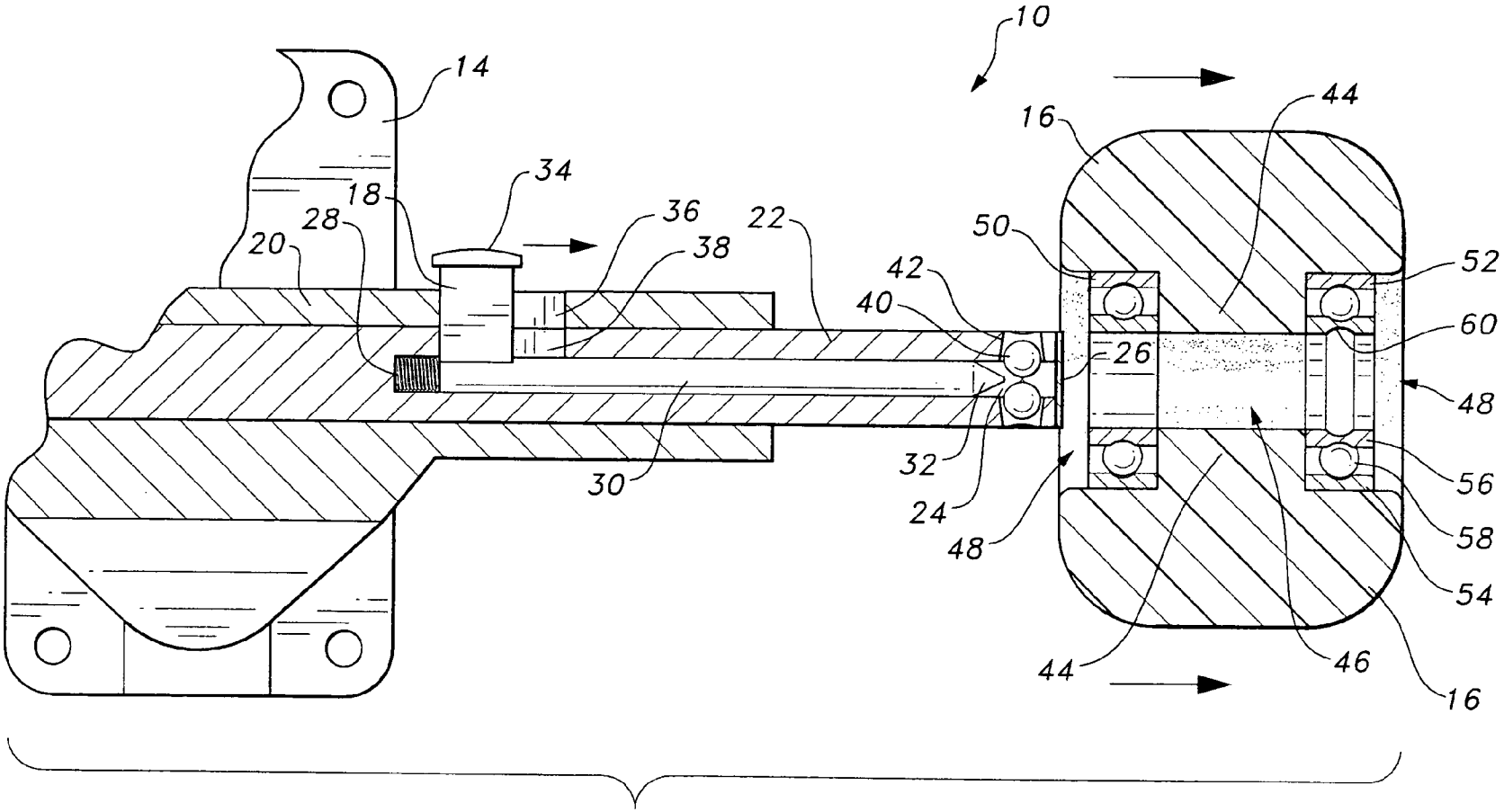
FIG. 3 is an exploded partial section view of the skateboard wheel and axle assembly according to the present invention, showing the detent pin in the retracted position.

Referring to FIGS. 2 and 3, each hangar 20 has an axle 22 extending through a bore defined through the hangar 20, a portion of the axle 22 extending beyond both ends of the hangar 20. Each end of the axle 22 has a blind bore 24 defined therein, which may be closed by an end cap 26 or plug. A bias spring 28, e.g., a helical compression spring, is loaded into the base or bottom of the blind bore 24. A detent pin 30 is slidably disposed in the bore 24 between spring 28 and end cap 26. The detent pin 30 may have a conically shaped end 32 that tapers to a point facing the end cap 26, as shown. The detent pin 30 also includes a release arm 18 extending orthogonal to the axis of the pin 30. The release arm 18 may be capped by a button 34 or the like.

Axle 22 has a slot 36 defined therein, extending orthogonal to, and communicating with, blind bore 24. Hangar 20 also has a slot 38 defined therein aligned with the slot 36 in axle 22. Release arm 18 extends through the aligned slots 36 and 38. Button 34 is attached to release arm 18 external to hangar 20. Compression spring 28 normally biases detent pin 30 towards end cap 26. Release arm 18 may be pushed or pulled medially to retract the pointed end 32 of detent pin 30 away from end cap 26.

A plurality of detent balls 40 are disposed in blind bore 24 adjacent end cap 26. Axle 22 has transverse bores 42 defined therethrough adjacent end cap 26. Transverse bores 42 are preferably hemispherical or frustoconical in shape, having a wider diameter on the interior surface of blind bore 24 than on the exterior surface of the axle 22. The diameter of each transverse bore 42 is slightly greater than the narrowest diameter of transverse bore 42 so that a significant portion of detent balls 40 (e.g., up to, but less than, one-half the volume of the detent ball 40) protrude from the axle 22 when detent pin 30 is biased to extend between the detent balls 40, as shown in FIG. 2. Detent pin 30 may be retracted, as shown in FIG. 3, so that detent pin 30 no longer urges detent balls 40 into transverse bores 42, whereupon detent balls 40 may partially collapse into blind bore 24, but are prevented from moving axially in blind bore 24 by the relative diameters of the bore 24 and the balls 40.

Referring particularly to FIG. 3, each wheel 16 may be a conventional urethane skateboard wheel 16 having an integral wheel hub 44 formed therein. Each wheel 16 has a central bore 46 defined therethrough slightly larger in diameter than the axle 22 in order to permit the axle 22 to pass through the wheel 16. Each wheel 16 also has interior and exterior peripheral bores 48 defined therein coaxial with central bore 46 but of greater diameter than central bore 46, thereby defining a hub 44 that provides a shoulder for seating inner bearings 50 and outer bearings 52. Bearings 50 and 52 may be ball bearing assemblies having an outer race 54 that forms a friction fit against the wheel 16, an inner race 56 that fits snugly over axle 22, and bail bearings 58 disposed between the inner race 56 and the outer race 54.

In the present invention, the inner race 54 of each outer bearing 52 has an annular detent groove 60 defined therein. Although wheels 16 are shown in the drawings with an integral hub 44, it will be understood that the present invention also extends to skateboard wheels having of various types, such as skateboard wheels having a discrete hub made of plastic or steel inserted through the center of the wheel, wheels having spacers between the inner and outer bearings, etc.

In operation, detent pin 30 is moved to the retracted position shown in FIG. 3 by pushing or pulling release arm 18 medially, thereby compressing spring 28 and permitting detent balls 40 to partially collapse into blind bore 24. Wheel 16 may then be pushed onto axle 22 until hangar 20 bears against inner bearing 50, aligning transverse bores 42 with detent groove 60. Release arm 18 is then relaxed, compression spring 28 expanding to urge detent pin 30 towards end cap 26 and between detent balls 40, urging detent balls 40 to partially protrude through bores 42 and lodge in detent groove 60, thereby locking the wheel 16 onto the axle 22. Ball bearing assemblies 50 and 52 provide for rotation of wheels 16 around axles 22.

In order to remove the wheel 16, release arm 18 is pushed or pulled medially to retract detent pin 30, permitting detent balls 40 to partially collapse into blind bore 24, thereby permitting wheel 16 to be pulled from the axle 22.

Although described with respect to a skateboard, it will be understood that the wheel and axle assembly may be used with any land vehicle (e.g., carts, trays, etc.) or toy that uses wheels having a bearing with an inner race that can define a detent groove, and preferably having an axle housing in which a slot can be defined as a guide for release arm 18. It will also be understood that although only two detent balls 40 are shown in the drawings, the wheel and axle assembly may have more than two detent balls 40 extending radially from the axle 22.

It is to be understood that the present invention is not limited to the embodiments described above, but encompasses any and all embodiments within the scope of the following claims.

I claim:

1. A wheel and axle assembly, comprising:

a wheel having a wheel hub;

a ball bearing assembly rigidly disposed in the wheel hub, the ball bearing assembly having an inner race, the inner race having an annular detent groove defined therein;

an axle having a blind bore extending axially therein, an end cap closing the blind bore, a plurality of transverse bores defined radially therein communicating with the blind bore adjacent the end cap, and a slot defined therein communicating with the blind bore;

a compression spring disposed in the blind bore;

a detent pin slidably disposed in the blind bore between the compression spring and the end cap, the detent pin having a release arm extending through and slidable in the slot defined in the axle, the detent pin having an engaging end facing the end cap; and a plurality of detent balls at least partially disposed in the transverse bores, the compression spring biasing the detent pin to an extended position between the detent balls so that a portion of each the detent balls protrude from the axle through the transverse bores and engage the detent groove in the wheel bearing in order to releasably lock the wheel on the axle, the detent pin being movable to a retracted position by sliding the release arm in the slot so that the detent balls partially collapse into the blind bore in order to release the wheel from the axle.

2. The wheel and axle assembly as recited in claim 1, further comprising an axle housing having a slot defined therein, the axle extending through the axle housing, the axle housing slot being aligned with the slot defined in said axle, said release arm extending through and being slidable in the aligned slots, a portion of said axle including the transverse bores extending from the axle housing and being slidable within the inner race of said ball bearing assembly.

3. The wheel and axle assembly according to claim 2, wherein said axle housing comprises a truck adapted for attachment to a skateboard.

4. The wheel and axle assembly as recited in claim 2, wherein the release arm has a free end, a user-engagable member being mounted on the free end.

5. The wheel and axle assembly as recited in claim 1, wherein each said transverse bore has a substantially frustoconical shape.

6. The wheel and axle assembly as recited in claim 1, wherein each said transverse bore has a substantially hemispherical shape.

7. The wheel and axle assembly as recited in claim 1, wherein the engaging end of said detent pin has a substantially conical shape.

8. The wheel and axle assembly as recited in claim 1, wherein the detent groove has a substantially arcuate cross-sectional contour.

* * * * *